US006190291B1

(12) United States Patent
Schwarz

(10) Patent No.: US 6,190,291 B1
(45) Date of Patent: Feb. 20, 2001

(54) FITNESS METHOD

(76) Inventor: Leonard Schwarz, 5526 Northumberland St., Pittsburgh, PA (US) 15217

( * ) Notice: Under 35 U.S.C. 154(b), the term of this patent shall be extended for 0 days.

(21) Appl. No.: 08/883,122

(22) Filed: Jun. 26, 1997

(51) Int. Cl.[7] ..... A63B 21/00
(52) U.S. Cl. ..... 482/91; 482/148
(58) Field of Search ..... 482/91, 111, 23, 482/44, 45, 49, 109, 108, 148

(56) References Cited

U.S. PATENT DOCUMENTS

| | | | | |
|---|---|---|---|---|
| 3,016,812 | | 1/1962 | Chatlain . | |
| 3,408,750 | | 11/1968 | McCollough et al. . | |
| 4,015,344 | | 4/1977 | Michaels et al. . | |
| 4,337,049 | | 6/1982 | Connelly . | |
| 4,466,610 | * | 8/1984 | Isreal | 482/91 |
| 4,508,510 | | 4/1985 | Clifford . | |
| 5,169,362 | | 12/1992 | Schwartz . | |
| 5,354,253 | * | 10/1994 | Awbrey | 482/111 |

FOREIGN PATENT DOCUMENTS 7522 of 1913 (GB) .

OTHER PUBLICATIONS

Hewitt, Isometrics–The Short Cut To Fitness, 1980.*

Petrofsky, Isometric Exercise and It's Clinical Implications, 1982.*

* cited by examiner

*Primary Examiner*—Jerome W. Donnelly

(57) ABSTRACT

A fitness method for an exerciser combines the benefits of isometric-like exercising with isotonic exercising for simultaneous training of the exerciser's cardiovascular and skeletal musculature systems and strength and endurance buildup. The method entails coupling the exerciser's hands together in any one of a number of configurations and generating an isometric-like force during the coupling stage. The coupled hands can then be moved in any number of directions or coupled differently while maintaining or varying the isometric-like force during the movement. In addition, further training can be achieved by moving one or more other body parts during the coupled hand movement. The legs, torso, shoulders, and/or neck can be moved in any number of directions or sequences to exercise different muscle groups in conjunction with the muscle groups being worked by the movement of the coupled hands.

5 Claims, 1 Drawing Sheet

FITNESS METHOD

FIELD OF THE INVENTION

The present invention is directed to a fitness method and, in particular to a fitness method that combines isometric-like physical activity with isotonic physical activity to achieve both endurance and strength.

BACKGROUND ART

In the prior art, the concept of dynamic tension or isometrics is well known, having been popularized by Charles Atlas many years ago. The concept of isometrics involves pitting one or more muscle groups against other muscle groups in a stationary fashion. Typically, one hand of an exerciser is pushed against or pulled apart from the other hand with the other hand imparting an opposite and generally equal force. Neither hand nor the exerciser's body is typically moved during the pushing or pulling of the hands.

One of the drawbacks to the system of isometrics is the inability to generate sufficiently large workloads to involve the circulation (heart rate especially) appreciably. For one thing, the duration of each isometric exercise is too brief; for another the muscle mass involved in the exercise was generally too small. Consequently, isometric exercise only provides strength improvement and does not contribute to endurance, flexibility, aerobic training or the like.

Another common form of exercising involves movement, i.e. isotonics. Examples of these types of exercises include swimming, running, rowing, biking, aerobics and the like. While these exercises offer superb cardiovascular training, they are often deficient in building strength or using a large volume of muscle simultaneously.

One other form of exercising is a hand weight-assisted whole body exercise known as Heavyhands® that was developed by the inventor. In this exercise, hand weights are utilized during walking, jogging or the like in an effort to combine aerobic or cardiovascular training with strength training.

Presently, there is a large emphasis on exercise equipment or devices that are designed to work a single muscle group only, e.g., abdominal exercising machines, treadmills, stationary bikes, etc. Often times, these types of equipment, while driving the heart rate up, may not exercise enough of the skeletal musculature to provide a complete body workout. For example, there are important leg group muscles that are not adequately exercised during running or biking. Other equipment may ignore upper body strength, overall flexibility and many other muscles, including the low back and abdomen. Further, equipment that may provide a more extensive workout may be cost prohibitive for many to use.

In view of the many disadvantages with present day exercise techniques and devices in terms of cost, insufficient muscle volume utilization, monotonous routines, inadequate cardiovascular training and the like, a need has developed to provide an exercise method or routine which overcomes the disadvantages with the prior art systems noted above. In response to this need, the present invention provides a fitness method that does not require any exercise equipment or device(s) and provides both strength and endurance training simultaneously.

SUMMARY OF THE INVENTION

Accordingly, it is a first object of the invention to provide a fitness method that combines the benefits of isometrics and isotonics.

Another object of the invention is a fitness method that does not require the use of any exercise equipment or apparatus.

A further object of the invention is a fitness method that permits an exerciser to achieve strength training simultaneously with endurance training and whole body flexibility.

A still further object of the invention is a fitness method that can be utilized to train the entire skeletal musculature and cardiovascular system to build strength, endurance and flexibility, simultaneously.

One other object of the invention is a fitness method that can be used to develop sports-related skills such as baseball bat or golf club swinging, oar rowing, bowling, tennis racquet swinging or the like.

Other objects and advantages of the present invention will become apparent as a description thereof proceeds.

In satisfaction of the foregoing objects and advantages, the present invention provides, in one embodiment, a fitness method for at least one individual exerciser comprising the steps of coupling at least a portion of each hand of the exerciser together. An isometric-like force is generated between the coupled portions of the hands; and the coupled portions are moved in space for a select period of time while generating the isometric-like force for training of the cardiovascular system of the exerciser simultaneously with training of the skeletal musculature of the exerciser.

In one mode, the coupled hands can be moved without actively moving other parts of the body. The exerciser could be standing or seated while moving the coupled hands. Alternatively, one or more other parts of the exerciser's body can be moved while the coupled hands are being moved. The other body parts can include the legs including the feet, the torso, the neck, the shoulders, etc.

The coupled hands can be linked in any fashion that will permit the generation of the isometric-like force and can be moved in space in any number of directions or speeds, e.g., vertical, horizontal or oblique directions, slow, fast or moderate speeds and/or combinations or variations thereof.

The other body part movements can also be in any direction, any type and at any rate. For example, the legs can be moved in a sidestepping fashion, the torso can be bent over from an upright stance or the neck can be gyrated in a circular motion.

The isometric-like force can also be varied during the exercise routine. In generating the force, typically, one hand pulls against the pull of the other hand or one hand pushes against the push of the other. In true isometrics, the push or pull of one hand would offset the push or pull of the other hand so no movement would occur. In the inventive fitness method, the pull or push of one hand (the force) is different from the pull or push of the other hand to allow the coupled hands to move in space. During the coupled hand movement, the isometric-like force is being generated to at least some degree to achieve the strength training with the cardiovascular training.

The coupled hand configurations can be any type that permits the generation of the isometric-like force, including horizontal, vertical, oblique or combinations thereof. Examples include interlocking the fingers so that fingers of one hand engage the webs between fingers of the other hand. The tips of the fingers of one hand could curl to engage the tips of the fingers of the other hand. In yet a further configuration, the fingers of one hand could be positioned between the index finger and thumb of another hand so that the hands are clasped together. The coupled hands can be moved through any type of a trajectory during the exercise routine, including side to side, up and down, a figure eight movement, an oblique movement or combinations or sequences thereof.

The coupled hand movements can be selected or changed for the routine depending on the muscles intended to be worked. Certain hand configurations and movements can work certain muscles better than other muscles.

Any mode of the inventive method can be practiced in an aqueous medium such as water wherein at least a part of an exerciser's body is in water during movement of the coupled hands or hands/body parts. The hands, legs, torso, shoulders, head or the like could be completely or partially submerged during exercising.

In one mode, to achieve both strength and cardiovascular training simultaneously, heretofore unavailable with conventional forms of exercise, the moving of the hands and/or other body parts can be done repetitively and in sufficient quantity along with application of the isometric-like force, preferably slow, hard pulling/pushing of the hands.

BRIEF DESCRIPTION OF THE DRAWINGS

Reference is now made to the drawings of the invention wherein.

DESCRIPTION OF THE PREFERRED EMBODIMENTS

The inventive fitness method is an integrated exercise system combining strength, endurance and flexibility. Moreover, the fitness method is convenient to perform, does not require any fitness equipment or devices and is especially apt to increase total exercise volume. In contrast to many of the tedious prior art exercise routines, with or without equipment, the inventive fitness method, by its unique nature of providing a well balanced workout without the need to rely upon some inanimate object, can instill an attitude in an exerciser which can make the fitness routine more pleasurable while still requiring the exerciser to work diligently.

A fundamental aspect of the fitness method is the connection or coupling between two body parts, preferably the exerciser's hands. The method will be described using hand coupling but other parts could be coupled together, e.g., hand and feet, hand and knee, foot and foot, etc. It is this coupling that combines the benefits of isometric exercise with movement of the hand coupling for isotonic exercise. In its broadest embodiment, the hand coupling can have any configuration that will allow the exerciser to generate the isometric-like force between the hands. Generation of the isometric-like force is defined as one hand exerting a force on the other hand while the other hand exerts another force on the one hand so that some resistance or tension is created between the hands. In a true isometric force generation, the hands would remain still since the force applied by each hand would be offset. However, according to the invention, the isometric-like force is generated so that the hands, when coupled together and applying forces on each other, can still move through space.

Figure 1:
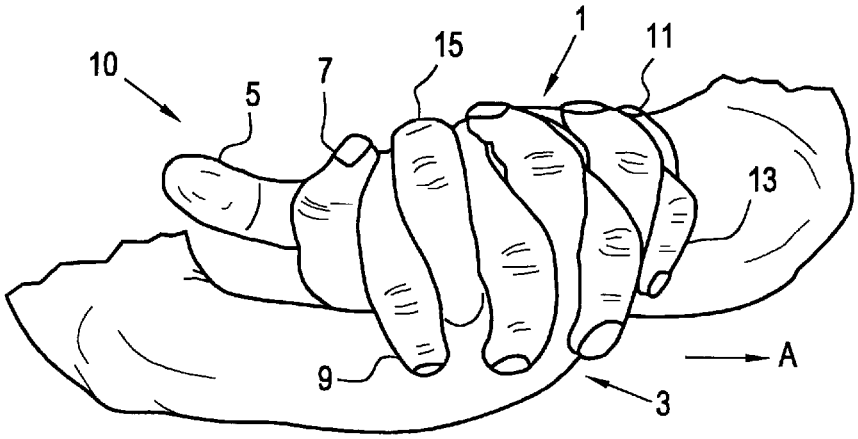
FIG. 1 is front view of one type of a hand coupling for the inventive fitness method.

Although a wide variety of hand couplings are within the bounds of the invention, certain configurations are more preferred. With reference to FIG. 1, a first hand coupling is designated by the reference numeral 10 and includes hands 1 and 3 arranged generally horizontally with the hand 1 on top of the hand 3. In this configuration, the thumb 5 is outside of the thumb 7. The thumb 7 is positioned in the web between the top hand index finger 9 and the thumb 5. The bottom hand pinkie 11 is outside of the top hand pinkie 13. Of course, the hands 1 and 3 could be reversed so that the hand 3 is on the top and the hand 1 is on the bottom.

In yet a further variation, the thumb 5 of the hand 1 could be positioned in the webbing between the thumb 7 and index finger 15 of the hand 3 so that the bottom hand thumb 7 is outside of the top hand thumb 5. In this variation, the top pinkie 13 is outside of the bottom pinkie 11.

Figure 2:
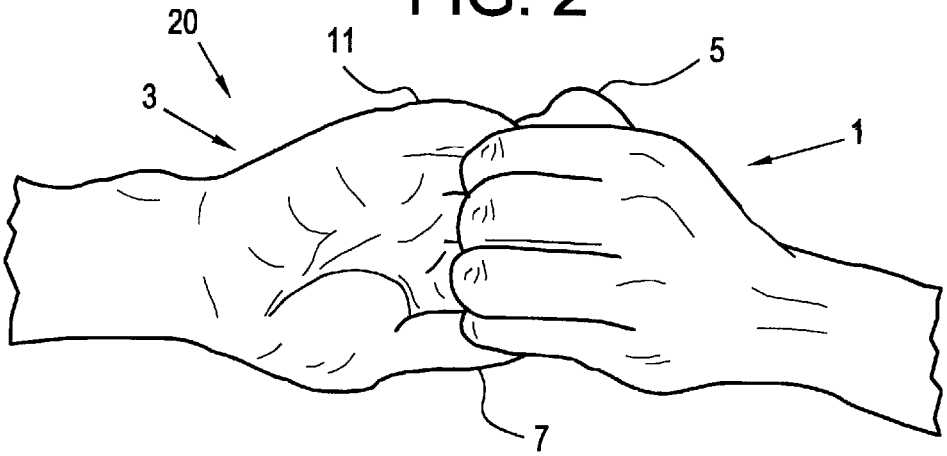
FIG. 2 is a front view of a second type of a hand coupling for the inventive method.

In FIG. 2, a second hand coupling is designated by reference 20 and shows fingertips of hand 1 in a curled shape and engaging the curled fingertips of hand 3. In this coupling, the thumb 7 is on the bottom of the coupling and the thumb 5 is on the top. Again, the hands 1 and 3 could be reversed so that the thumb 5 is on the bottom.

Figure 3:
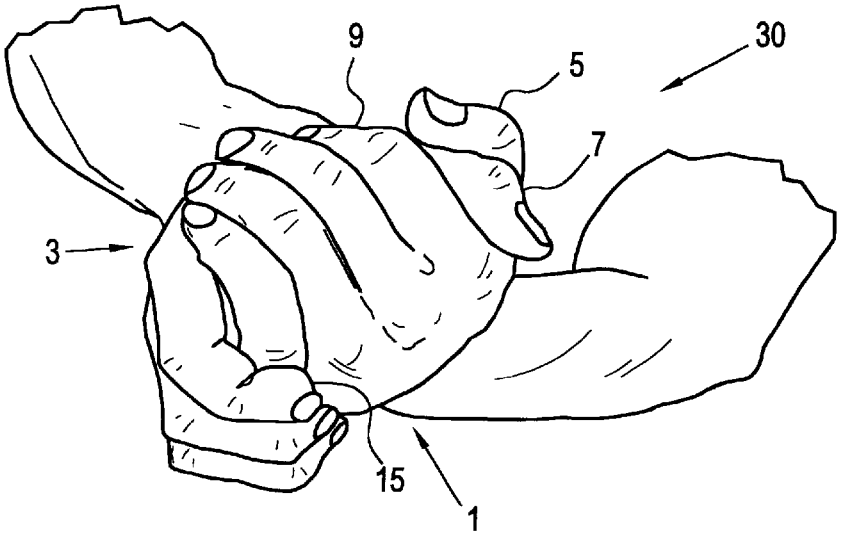
FIG. 3 is a front view of a third type of a hand coupling for the inventive method.

FIG. 3 shows a third configuration wherein the hands 1 and 3 are clasped together. In this configuration, the hand 3 has its thumb 7 positioned between the thumb 5 and the index finger 9 of the hand 1. The fingers of the hand 1 are between the thumb 7 and the index finger 15 of the hand 3. The hands 1 and 3 could also be reversed so that the fingers of the hand 3 are between the index finger 9 and thumb 5 of the hand 1.

The hand coupling can be aligned vertically, horizontally, obliquely or the like. For example, the configuration in FIG. 1 could be rotated so that the palms and finger knuckles of the hands are generally vertical. This type of hand coupling could then be moved vertically, horizontally, obliquely or in sequences or combinations thereof. In FIG. 2, the hands could be rotated 90° as well so that one hand is above the other.

Referring again to FIG. 1, once the hand coupling is formed, the isometric-like force as defined above is generated either before, after or simultaneously with moving the hand coupling through space. That is, the hand 1 could pull or accelerate the hand 3 in the direction "A" with the hand 3 pulling against or braking against the pulling or acceleration of the hand 1. The extent of the movement in direction "A" is variable with respect to the exerciser. Once movement in direction "A" is stopped and the hand coupling is displaced to an exerciser's side or other body area, the hand coupling is moved back in a direction opposite "A" to an extent determined by the exerciser. This back and forth motion is continued while the isometric-like force is generated at the hand coupling.

The movement through space can take any trajectory or path. For example, the hand coupling of FIG. 1 could be moved side to side or horizontally, up and down or vertically, in a slanted direction or obliquely, in a sinusoidal pattern, rotated while moving in a trajectory, or in one or more combinations or sequences of these movements. The hand coupling can be positioned in any vertical orientation when moving in a non-vertical direction.

The speed and isometric-like force generation of the hand coupling can also vary during the fitness method routine. For example, the hand coupling could be rapidly moved through space for 5–10 repetitive sequences followed by 5–10 sequences at a slower speed. Slow movements favor the strength component of the fitness method, but without totally neglecting the endurance factor. Fast movements favor the aerobic component of the method. However, as in any rapid exercising motion, when the body tempo is increased, maxing out (reaching absolute aerobic capacity forcing one to quit or slow down) can be avoided by easing the forces acting upon the hands or truncating the extent of the motion. Speed is also related to the hand coupling since the isometric-like force controls the hand movement to some extent. If the counteracting forces of the hands are equal, no movement can occur. With faster movements, the force differences are greater. Varying the tempo contributes to a more balanced workout by involving more muscle groups.

Likewise, the pulling or accelerating motion of one hand against the other hand can also vary, particularly, depending on the exerciser's strength and endurance levels. At the onset of practicing the inventive fitness method, the isometric-like force generation may be relatively small but typically build ups with continued exercise (training effects).

As stated above, different muscle groups can be worked depending on the range of motion of the hand coupling, the tempo used, the force generated, etc. For example, with the hand coupling described above wherein the fingers are interlaced, the thumbs are on top and the palms are vertical, pushing one hand against the resistance of the other hand works the pectorals as well as other intrinsic and extrinsic arm muscles. When one hand is pulling against the pull of the other, the deltoids are maximally trained with the other intrinsic and extrinsic muscles.

In another example, referring to the FIG. 1 hand coupling, moving the coupling through space with the bottom pinkie outside the top pinkie works different muscles than if the top pinkie is outside of the bottom pinkie. A significant advantage of the inventive fitness method is the ease in which a fatigued muscle group can be rested in favor of another muscle group merely by changing the hand coupling, force, tempo and/or trajectory in which the coupling is being moved.

The movement of the hand coupling can be combined with movement of another body part to further enhance or optimize certain effects of the workout. Combining the hand coupling with the movement of one or more body parts allows for the capture of all of the major muscle groups and most small groups (a greater percentage of the entire musculature). Examples of body parts to be moved with the hand coupling include the legs, feet, the trunk or torso, the neck, the shoulders, or sequences or combinations thereof. Movements include walking, standing, sitting, jogging, skipping, lunging, side-stepping, kicking, dancing, sprinting, bending over, bending backward, bending sideways, squats, knee raises, kick-backs, kicks in varying directions, combinations thereof and the like. The tempo of the other body part movement(s) can also be controlled to attain the desired level of activity.

Leg and trunk strength may be readily gained during the fitness method routine. Moves involving these body parts increase the quadricep, hamstring and abductor muscle strength. Frequent sideleans and bodyflexes assure almost continual work of the abdominal and paraspinous muscles during every routine.

Variety makes for the inclusion of more muscle in the method. Variety is assured by frequent changes of the hand coupling, varied trajectories, changes in the application of the isometric-like force, changes in tempo and range of motion and leg movements that include strides to the sides for the abductor groups of the legs. Body dance routines can be readily improvised, using various mixes and matches of the hand coupling with the lower body parts. With this variety, the inventive fitness method can use more muscle volume per unit time than several of the currently used exercise machines.

The inventive method also emphasizes major muscle groups of the upper body such as the deltoids and latissimus dorsi while building strength and endurance.

The fitness method can be utilized in a sitting position or with the other body parts, e.g., hand(s) and knee(s). When sitting with the feet flat on the floor and at shoulder width, at least one hand can be coupled with a knee for generation of the isometric-like force. The hand pushes the knee toward a body midline and leg resistance, then the knee pushes the hand outward against hand resistance. At the same time, body flexes can be done during the first phase with recovery occurring in the second phase. In this mode, a hand is coupled to a body part other than a hand as part of the fitness method. Other couplings such as feet and hand, foot and foot, etc. can be employed as well so long as the advantage of muscle loading, the inclusion of a large volume of simultaneously acting muscle is not ignored.

By tailoring the hand coupling and/or other body part(s) movement to a desired sports move, an exerciser can also train for an activity while developing both strength and endurance. For example, an exerciser could simulate a baseball bat swing with the trajectory of the hand coupling. Moreover, leg movement simulating the transfer of weight that typically occurs when swinging a bat could be combined with the hand coupling movement. Other sport motions could include golf club swinging, cesta swinging, rowing, bowling, tennis or any other sport that involves shoulder and/or total body movement.

The method of the invention runs counter to the school of thought that to gain strength and endurance, separate exercises must be performed. With the inventive method, an exerciser includes large volumes of muscle as part of the exercise routine to enhance strength while building endurance. Strength training focuses on small groups of or individual muscles. Similarly, aerobic training focuses on the cardiovascular system and does not build strength. With the inventive fitness method, significant advantages are realized over conventional weight/strength training. In conventional strength training, repetitions are limited; muscle mass is increased (hypertrophy) but aerobic or metabolic power is diminished; few mitochondria and capillaries are developed; training is done in an anaerobic mode; a low calorie output per minute is generated; rest days are usually required; one or just a few muscle groups are utilized; maximal mass or girth is obtained; a chance of injury is increased; sports only requiring pure prolonged strength are benefited, and relatively few moves are encountered (boring).

With the fitness method of the invention; rest days are not usually required; a high calorie output per minute is achieved; girth is obtained without loss of endurance; endless variations are available, thereby making the exercising interesting; a wider selection of sport moves are available; muscle hypertrophy and many mitochondria and capillaries (increased muscle mass with increased aerobic or metabolic power) are produced and muscle groups are used simultaneously.

The fitness method can be practiced virtually anywhere since no equipment or other objects or tools are needed. Examples include waiting for the microwave, at one's desk during work, during TV watching, as a warm-up when awakening and the like. The time of practice can also be varied depending on the individual and the needed or desired level of activity.

In the inventive fitness method, water may, for some, be an alternative or even a preferred medium within which to perform the exercise. All of the described hand coupling means and movements can be executed, for example, while the host is immersed in the shallow portion of the pool. In this situation, the exerciser may perform any of the above described leg movements while the coupled hands are performing either beneath the water or above it. This form of the inventive method may be used either exclusively or at some selected frequency to bring relief to one or more painful conditions that typically afflict the knee and hip joints as well as the spine. Water exercise is known to relieve pain in joints or the like, but in the case of the inventive method, an exerciser enjoys the added benefits through the movement of the coupled hands along with the addition of force. When the hands are deployed beneath the water surface, the described effects then come to include the resistance created by the aqueous medium itself as well as the support, through buoyancy, of the coupled hands.

By the inventive method, the exerciser, suprisingly, can promote greater maximal or submaximal endurance or cardiovascular capacity even while actually emphasizing the strength building aspect of the workout. This effect is unique and probably occurs (1) because a greater percent of the volume of the entire musculature is involved; (2) the type of strength gained is actually of different quality than is conventionally acquired strength and is acquired while performing hundreds, even thousands, of consecutive repetitions; (3) this form of whole body strength as defined by the inventive method actually produces more muscular mitochondria and capillaries as does conventional aerobic exercise.

The capability of strength building in combination with cardiovascular training, as developed by practicing the inventive method, erases the prevailing conflict between strength and endurance. An exerciser now has the capability, convenience and pleasure of acquiring both strength and endurance simultaneously. This concept which can be described as longstrength applies to the prolonged workouts needed to achieve the effect and to the quality of strength produced that can be continued far longer than is the case with conventional strength oriented exercise.

The inventive fitness method offers the following advantages over other types of exercise regimens; (1) more muscles can be used during a routine than typical exercises using some form of equipment or focusing on one set of muscles; (2) the elements of strength, cardiovascular training and flexibility as well as other fitness elements are components of the inventive routine; (3) an exerciser's movements in combination with the hand coupling movement is unlimited, thereby providing a constant state of exercise variation during the routine; (4) high calorie loss is achieved; (5) weekly exercise time can increase due to the inherent flexibility in where the routine can be performed; (6) exercisers simultaneously become stronger, leaner, more flexible and more aerobically fit; (7) specific sports moves as they relate to the exercise routine can improve; (8) a more positive attitude is obtained regarding exercise in general so exercise in other forms is enjoyed; and (9) exercise becomes more habit forming over an exerciser's lifespan.

Accordingly, an invention has been disclosed in terms of preferred embodiments thereof which fulfill each and every one of the objects of the present invention as set forth above and provides a new and improved fitness method.

Various changes, modifications and alterations from the teachings of the present invention may be contemplated by those skilled in the art without departing from the intended spirit and scope thereof. Accordingly, it is intended that the present invention only be limited by the terms of the appended claims.

The invention claimed is:

1. An exercise method that fuses whole body muscular strength with overall muscular endurance and flexibility, cardiovascular efficiency, and skill without the need for any external exercise equipment, comprising the steps of:

a) developing upper body strength by first clasping the hands of the exerciser together, and then moving the arms of the exerciser back and forth in a generally back and forth lateral motion, and at the same time having one hand pulling the other hand when moving the clasped hands and arms in one direction, the other hand pulling on the one hand when moving the clasped hands and arms in another direction, the pulling of one hand against the other aiding in said development of upper body strength through resistance by the other hand, wherein the step of clasping the hands further comprises moving the clasped hands in at least four segments whereby the palms are:

i) generally facing each other with one hand beneath the other and the fingers intertwined, the under hand being the pulling hand and the thumb of the under hand leading the movement of the hand clasp in the one direction as the first segment;

ii) generally facing each other with one hand over the other and the fingers intertwined, the over hand being the pulling hand and the thumb of the over hand leading the movement as the second segment;

iii) generally facing each other with one hand beneath the other and the fingers intertwined, the under hand being the pulling hand and the little finger of the under hand leading the movement as the third segment; and iv) generally facing each other with one hand over the other and the fingers intertwined, the over hand being the pulling hand and the little finger of the over hand leading the movement as the fourth segment;

v) controlling the back and forth lateral motion of the arms between horizontal, vertical and oblique directions, selection of one of the horizontal, vertical and oblique directions developing additional upper body strength by working muscles linked to the selected back and forth lateral motion directions;

vi) varying a range and tempo of the back and forth motion as part of said upper body strength development and to gain endurance and flexibility; and vii) varying a pulling force of one hand on another during the back and forth motion as part of said upper body strength development;

b) during the back and forth movement of step (a), changing the hand clasps between each of the first through fourth segments as part of the fitness method, the changing of the clasps as part of said back and forth movement allowing an exerciser to work the entire upper body musculature;

c) at the same time of moving and controlling the back and forth lateral motion of steps (a) and (b), flexing the exerciser's torso repeatedly, with varying tempo and in concert the arm motion to enhance work imposed on muscles of the upper body and to work muscles associated with the torso; and d) at the same time of moving and controlling of the arms and hand pulls of steps (a) and (b), and movement of the torso of step (c), moving the legs repeatedly in step with the varying movements of the torso and arms to enhance the musculature work imposed on the torso and upper body while working leg muscles;

e) whereby the simultaneous and varying movements of the upper body via the arms and clasped hands, the torso, and the legs results in:

i) development of whole body musculature and the ability to use increased amounts of muscle volume per unit time than exercises focusing on selected body portions of an exerciser;

ii) gains of overall flexibility through orchestration of muscles, joints, ligaments, and tendons worked by said simultaneous and varying movements;

iii) improved endurance in conjunction with said development of whole body musculature;

iv) increased cardiovascular effects by mobilizing large amounts of skeletal muscle as part of said simultaneous and varying movements; and v) increased skills of the exerciser based on selection of particular skill-related movements.

2. The method of claim 1, further comprising controlling the movement in at least one of steps (a), (b), (c) and (d) to regulate the degree of strength, flexibility, and endurance in muscles associated with each step.

3. The method of claim 1, wherein, in addition to the movement in the first through fourth segments, the clasped hands are moved in a fifth segment whereby the fingertips of one hand engage the fingertips of the other hand, each hand being rotated about 180 degrees and the fingertips are then reengaged for changing movement as part of step (b).

4. The method of claim 1, wherein, in addition to the movement in the first through fifth segments, the clasped hands are moved in a sixth segment whereby the fingers of one hand are between the index finger and a thumb of the other hand, and the fingers of the other hand are between the index finger and the thumb of the one hand, each hand being rotated about 180 degrees and the fingers are then reengaged between the thumbs and index fingers for changing movement as part of step (b).

5. The method of claim 1, wherein at least a portion of an exerciser's body is in water.

* * * * *

UNITED STATES PATENT AND TRADEMARK OFFICE

CERTIFICATE OF CORRECTION

PATENT NO. : 6,190,291 B1
DATED : February 20, 2001
INVENTOR(S) : Leonard Schwartz It is certified that error appears in the above-identified patent and that said Letters Patent is hereby corrected as shown below:

Please correct the inventor's name to read Leonard Schwartz

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*